United States Patent [19]

Fraikin et al.

[11] 4,442,013

[45] Apr. 10, 1984

[54] CONCENTRATED FABRIC SOFTENING COMPOSITIONS

[75] Inventors: Marie-Helene Fraikin, Herstal; Alan Dillarstone, Rocourt, both of Belgium

[73] Assignee: Colgate-Palmolive Company, New York, N.Y.

[21] Appl. No.: 360,726

[22] Filed: Mar. 22, 1982

[51] Int. Cl.[3] ..... D06M 13/46

[52] U.S. Cl. ..... 252/8.8; 252/8.6

[58] Field of Search ..... 252/8.8

[56] References Cited

FOREIGN PATENT DOCUMENTS 18039 10/1980 European Pat. Off. ..... 252/8.8

1601360 10/1981 United Kingdom ..... 252/8.8

*Primary Examiner*—Maria Parrish Tungol

*Attorney, Agent, or Firm*—Norman Blumenkopf; Herbert S. Sylvester; Murray M. Grill

[57] ABSTRACT

Stable concentrated fabric softener compositions comprising a mixture of an imidazolinium quaternary ammonium compound with a dicationic quaternary ammonium compound. Such compositions exhibit stable viscosity characteristics at both low and high ambient temperatures.

6 Claims, No Drawings

CONCENTRATED FABRIC SOFTENING COMPOSITIONS

BACKGROUND OF THE INVENTION

The present invention relates to fabric softener compositions adapted for the use in the rinse cycle of a laundering process and in particular to concentrated aqueous fabric softener compositions which exhibit stable viscosity characteristics at both low and high ambient temperatures, i.e. such compositions do not increase in viscosity to the point of forming a gel.

Compositions containing quaternary ammonium salts having at least one long chain hydrocarbyl group are commonly used to provide fabric softening benefits when employed in a laundry rinse operation; for example, see U.S. Pat. Nos. 3,349,033; 3,644,203; 3,946,115; 3,997,453; 4,073,735 and 4,119,545.

For most aqueous softener compositions containing cationic quaternary ammonium compounds as active ingredients, the concentration of such cationics has, in general, been limited to the range of about 3 to 6% by weight (see U.S. Pat. No. 3,904,533 and U.S. Pat. No. 3,920,565). Such a low concentration is generally necessitated by the fact that cationics form gels in water systems at concentrations at about above 8%, and while the use of electrolytes to lower the viscosity of such compositions is known (see in particular U.S. Pat. No. 4,199,545), such electrolytes are far from satisfactory from several points of view. On the one hand, from an economics point of view, the use of such electrolytes contributes to the cost of the product and this is generally undesirable. From a functional point of view, the electrolytes often do not perform as required particularly at concentrations of the cationics in the neighborhood of about 12–15%. And finally, while the performance of the electrolytes may mitigate most of the gelling problem, their use is far from satisfactory in providing a highly concentrated aqueous system of cationics which does not gel or severely change in viscosity within the usual range of temperatures encountered in the handling thereof, for example 0° F. (about −18° C.) up to about 140° F. (about 60° C.). In U.S. Pat. No. 3,681,241 a concentrated fabric softening emulsion is described which consists essentially of 3.5 to 6.5 parts by weight of a compound represented for example by distearyl dimethyl ammonium chloride from 3.5 to 6.5 parts by weight of an alkyl amido imidazolinium alkylsulfate and from 0 to 3 parts by weight of a different but similar fatty amido imidazolinium alkylsulfate, the latter allegedly providing low temperature stability for the composition. The total actives contemplated range from about 8 to 13%.

In U.S. Pat. No. 4,155,855, there are described concentrated liquid fabric softeners containing (1) a fabric substantive agent which may be a polyamine, an alkylpyridinium salt or mixture of the two and (2) a fabric softener, in which the polyamines have the formula:

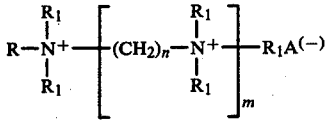

wherein R is $C_{10}$ to $C_{24}$ alkyl or alkenyl or $R—O—(CH_2)_n—$; $R_1$ may be hydrogen, hydroxyalkoxy groups, $C_1$ to $C_3$ alkyl etc.; n is 2 to 6 and m is 1 to 5 and $A^{(-)}$ represents a charge balancing anion or anions. Among the fabric softeners are alkylimidazolinium salts generally similar to those imidazolinium salts used in the compositions of the present invention. The composition contains 25% to about 55% of an active system of fabric substantive agent and fabric softening component, the former representing 25 to about 85% and the latter 15% to about 75% of the composition. In preferred aspects the fabric substantive component represents from 50 to 85% and preferably 65% to 80% and the softener 15 to 50% and preferable 20 to 35%. In all cases the lowest concentration of the fabric substantive component to the total of this plus softener is given (in terms of percentages) as 25% but based on the ratios of the two agents (6:1 to 1:4) this percentage could conceivably be as low as 20%.

SUMMARY OF THE INVENTION

The present invention provides low and high temperature stable, concentrated, aqueous softener compositions based upon imidazolinium softening compounds and a minor amount of a dicationic quaternary ammonium compound which per se is not a softener. The present invention also provides a method by which highly concentrated fabric softening compositions are produced.

DETAILED DESCRIPTION OF THE INVENTION

The compositions of the present invention are stable aqueous compositions which contain a high concentration of the cationic fabric softener which is a mixture of two different types of quaternary ammonium compounds as hereinafter described.

The aqueous compositions of this invention contain at least about 8% cationic softener up to about 25% thereof and preferably from about 9–15% thereof, said cationic softener comprising a mixture of an imidazolinium softener generally of the Formula (A)

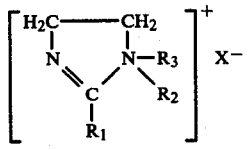

wherein:

$R_1$ is a $C_8$ to $C_{30}$ aliphatic radical and preferably a $C_{14}$ to $C_{18}$ alkyl or alkenyl;

$R_2$ and $R_3$ independently may be any of $R_1$ or preferably lower alkyl or substituted alkyl of $C_1$ to $C_4$ such as haloalkyl, hydroxyalkyl, acylaminoalkyl and the like;

X is a water-solubilizing anion such as chloride, bromide, iodide, fluoride, sulfate, methosulfate, nitrite, nitrate, phosphate, and carboxylate, (e.g. acetate, adipate, phthalate, benzoate, oleate, etc.);

the preferred compounds have the formula (AA)

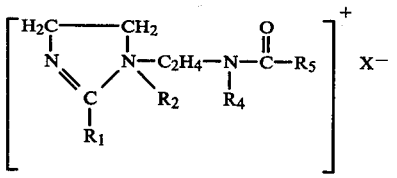

wherein:

$R_1$ is as defined in Formula (A);

$R_2$ may be any of $R_1$ or preferably lower alkyl or substituted alkyl of $C_1$ to $C_4$ such as haloalkyl, hydroxyalkyl and the like;

$R_4$ may be hydrogen or $C_1$ to $C_4$ alkyl or substituted alkyl;

$R_5$ may be any of $R_1$ and $R_2$, preferably $C_8$ to $C_{30}$ aliphatic and more preferably $C_{14}$ to $C_{18}$ alkyl or alkenyl; and X is as defined in Formula (A) and of a polycationic, polyquaternary quaternary ammonium compound of the general Formula (B)

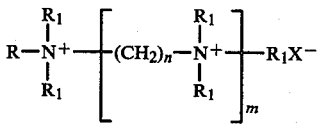

wherein the R group is selected from $C_{10}$ to $C_{30}$ aliphatic, preferably alkyl or alkenyl; or $RO-(CH_2)_n$- where R has same meaning as above, i.e. $C_{10}$ to $C_{30}$ aliphatic and preferably alkyl or alkenyl; the $R_1$'s may be hydrogen; $C_1$ to $C_4$ alkyl or hydroxyalkyl groups; n is an integer of 2 to 6 and m is an integer from 1 to 5; and X is as defined in Formula (A). The preferred compounds are those where R is $C_{12}$ to $C_{18}$ and $R_1$ is lower alkyl, especially methyl.

The concentration of the imidazolinium compound (A) may range from about 8 to 20% by weight of the total composition and that of the dicationic compound (B) may range from about 0.5 to 5% by weight of the total composition with a ratio of A to B ranging from about 40:1 to about 5:1 and preferably 15:1 to 7:1.

Typical imidazolinium softeners include the following within the above Formula (A)

2-heptadecyl-1-methyl-1-oleylamidoethyl imidazolinium ethosulfate 2-heptadecyl-1-methyl-1-(2-stearoylamido)ethylimidazolinium sulfate, 2-heptadecyl-1-methyl-1-(2-stearoylamido)ethylimidazolinium chloride, 2-coco-1-(2-hydroxyethyl)-1-benzyl imidazolinium chloride, 2-coco-1-(hydroxyethyl)-1-(4-chlorobutyl)-imidazolinium chloride, 2-coco-1-(2-hydroxyethyl)-1-octadecenyl imidazolinium chloride, 2-tall oil fatty-1-(2-hydroxyethyl)-1-benzyl imidazolinium chloride, 2-tall oil fatty-1-(2-hydroxyethyl)-1-(4-chlorobutyl)-imidazolinium chloride, 2-heptadecenyl-1-(2-hydroxyethyl)-1-(4-chlorobutyl)-imidazolinium chloride, 2-heptadecenyl-1-(2-hydroxyethyl)-1-benzyl imidazolinium chloride, 2-heptadecyl-1-(hydroxyethyl)-1-octadecyl imidazolinium ethyl sulfate, Typical dicationics of Formula (B) include the following:

N-Tallowyl-N,N,$N^1$,$N^1$-tetramethyl-1,3-propanediammonium dimethosulfate

N-Tallowyl-N,N$^1$,N$^1$-trimethyl-1,3-propanediammonium dimethosulfate

N-Oleyl-N,N,N$^1$,N$^1$,N$^1$-pentamethyl-1,3-propanediammonium dimethosulfate

N-Tallowyl-N,N,N$^1$,N$^1$,N$^1$-pentamethyl-1,3-propanediammonium dimethosulfate N-stearyl-N,N,N$^1$,N$^1$,N$^1$-pentamethyl-1,3-propanediammonium dimethosulfate N-stearyloxypropyl-N,N$^1$,N$^1$tris(3-hydroxypropyl)-1,3-propane diammonium diacetate In addition to the cationic components of the present invention, there may be also included in the aqueous compositions numerous conventional, supplemental materials or optional components which do not adversely affect the stability and/or functional characteristics of the present invention. Thus, for example, there may be present minor amounts of various surfactant materials and in particular certain surfactant phosphate esters which may be desirable to effect anti-static control of the laundered goods. Such conventional additional components also include perfumes, dyes, pigments, germicides, optical brighteners, anti-corrosion agents (sodium silicate) and the like. Where used, each of these may comprise e.g. 1% by weight of the instant compositions.

It may also be desirable to supplement and/or modify the viscosity features of the composition of this invention by the addition of electrolyte material such as calcium chloride, sodium nitrate, sodium formate and the like in amounts from about 0.05 to about 5% by weight. Minor proportions (0.5 to 10%) of other components may also be included such as the lower alkanols, e.g. ethyl and isopropyl alcohol as well as the conventional opacifiers particularly of the resin emulsion types so well known in this art.

The following examples will serve to illustrate the present invention without being deemed limitative thereof. Parts, where specified are by weight unless otherwise indicated.

EXAMPLE 1

The following composition is prepared:

| | % by weight |
|---|---|
| Deionized water | 73.05 |
| 1-methyl-1-tallow amidoethyl-2-tallow imidazolinium methosulfate | 15.00 |
| N—Tallowyl-N,N,N$^1$,N$^1$,N$^1$—pentamethyl-1,3-propane diammonium dimethyosulfate | 2.00 |
| Balance to 100% of color and perfume | |

This composition has a viscosity of about 240 cps just after preparation which increases to somewhat less than 400 cps after six weeks ageing at room temperature and to about 840 cps upon six weeks ageing at 43° C.(110° F.). At these values the product viscosity is squarely within the acceptable range of viscosities which varies from about 100 to about 1000 centipoises (cps) and preferably about 200 to about 800 cps. Without the dicationic in the composition and containing 0.1% NaCl we find the viscosity initially to be about 324 cps, 1700 cps after six weeks ageing at room temperature and 2300 cps after six weeks ageing at 43° C.

EXAMPLE 2

To 80 parts of deionized water there are added 0.05 parts sodium formate, followed by 15 parts of 1-methyl-1-stearyl amidoethyl-2-stearyl imidazolinium methosulfate and 2.0 parts of dicationic of Example 1. There are then added 0.05 parts of calcium chloride. A very satisfactory product results from the foregoing components as well as the operational sequence of component mixing.

EXAMPLES 3a–f

Each of Examples 1 and 2 is repeated except that in place of the dicationic thereof (2.0% by weight) there are used the following:

| | % by weight |
|---|---|
| (a) dicationic of Example 1 | 3.0 |
| (b) dicationic of Example 1 | 1.0 |
| (c) N—Tallowyl-N,N,N$^1$,N$^1$—tetramethyl-1,3-propanediammonium dimethosulfate | 2.5 |
| (d) N—Oleyl-N,N,N$^1$,N$^1$,N$^1$—pentamethyl-1,3-propanediammonium dimethosulfate | 1.5 |
| (e) N—Tallowyl-,N,N$^1$,N$^1$—trimethyl-1,4-butanediammonium dimethosulfate | 2.0 |
| (f) N—stearyloxypropyl,N,N$^1$,N$^1$—tris(3-hydroxypropyl)-1,3-propanediammonium diacetate | 2.0 |

EXAMPLES 4a–f

Each of Examples 1, 2 and 3a to 3f is repeated except that the cationic imidazolinium softener is replaced as follows:

| | % by weight |
|---|---|
| (a) 2-heptadecyl-1-methyl-1-oleylamidoethyl imidazolinium methosulfate | 12.0 |
| (b) 2-heptadecyl-1-methyl-1-oleylamidoethyl imidazolinium methosulfate | 14.0 |
| (c) 2-heptadecenyl-1-methyl-1-oleylamidoethyl imidazolinium methosulfate | 16.0 |
| (d) 2-heptadecenyl-1-(2-hydroxyethyl)-1-benzyl imidazolinium chloride | 12.0 |
| (e) 2-heptadecenyl-1-(2-hydroxyethyl)-1-benzyl imidazolinium chloride | 15.0 |
| (f) 2-heptadecenyl-1-(2-hydroxyethyl)-1-benzyl imidazolinium chloride | 10.5 |

We claim:

1. A stable, aqueous, concentrated fabric softening composition consisting essentially of water and about (a) 8 to 20% by weight of an imidazolinium softener compound of the formula:

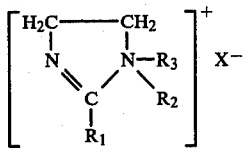

wherein $R_1$ is $C_8$ to $C_{30}$ aliphatic radical;

$R_2$ and $R_3$ are independently selected from $R_1$ radicals, or $C_1$ to $C_4$ alkyl or substituted $C_1$ to $C_4$ alkyl and X is a water-solubilizing anion, and (b) from about 0.5 to about 5% by weight of a polyquaternary compound of the formula:

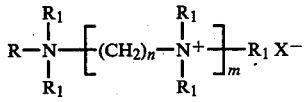

wherein

R is $C_{10}$ to $C_{30}$ aliphatic radical;

$R_1$'s are independently hydrogen, $C_1$ to $C_4$ alkyl or hydroxyalkyl;

n is an integer from 2 to 6;

m is an integer from 1 to 5; and

X is a water-solubilizing anion, the weight ratio of (A) to (B) ranging from 40:1 to 5:1.

2. A composition as defined in claim 1 including up to about 5% by weight of electrolyte.

3. A composition as defined in claim 1 wherein the imidazolinium softener is a 2-heptadecyl-1-methyl-(2-stearoylamidoethyl) imidazolinium salt.

4. A composition as defined in claim 3 where the polyquaternary compound is N-tallowyl-,N,N,N$^1$,N$^1$,N$^1$-pentamethyl-1,3-propanediammonium dimethosulfate.

5. A composition as defined in claim 4 wherein the amount by weight of compound A is about 15% and that of B is about 2%.

6. A method for preparing a composition as defined in claim 2 which comprises first preparing an aqueous solution of at least part of the electrolyte and thereafter adding the compounds (A) and (B) followed by the balance of any electrolyte.

* * * * *